US005964618A

United States Patent [19]

McCarthy

[11] Patent Number: 5,964,618

[45] Date of Patent: Oct. 12, 1999

[54] REMOVABLE DESKTOP ELECTRICAL RECEPTACLE UNIT

[76] Inventor: David G. McCarthy, 59 Applewood Dr., Huntington, Conn. 06484

[21] Appl. No.: 08/671,359

[22] Filed: Jun. 27, 1996

[51] Int. Cl.[6] ..... H01R 13/73

[52] U.S. Cl. ..... 439/574; 439/535

[58] Field of Search ..... 439/574, 575, 439/214, 650, 654, 135, 136, 535, 536, 538

[56] References Cited

U.S. PATENT DOCUMENTS

| | | | |
|---|---|---|---|
| 1,870,274 | 8/1932 | Wulfert et al. | 439/574 |
| 2,271,463 | 1/1942 | Reeves | 439/535 |
| 2,470,196 | 5/1949 | Thrasher | 439/574 |
| 3,049,688 | 8/1962 | Sinopoli | 439/41 |
| 3,297,886 | 1/1967 | Danner | 439/502 |
| 3,956,573 | 5/1976 | Myers et al. | 439/135 |
| 4,500,150 | 2/1985 | Leibensperger et al. | 439/650 |
| 5,057,039 | 10/1991 | Persing et al. | 439/574 |
| 5,124,506 | 6/1992 | Briggs et al. | 439/142 |
| 5,199,888 | 4/1993 | Condra et al. | 439/142 |
| 5,238,416 | 8/1993 | Dickie | 439/142 |
| 5,501,614 | 3/1996 | Tsuchiya | 439/574 |
| 5,788,521 | 8/1998 | Milan | 439/214 |

*Primary Examiner*—Paula Bradley
*Assistant Examiner*—Tho D. Ta
*Attorney, Agent, or Firm*—Mark P. Stone

[57] ABSTRACT

An electrical receptable unit includes a mounting element extending from a housing for removably mounting the unit to a working surface, as for example, a desktop. A tensioning adjustment element associated with the mounting element removably secures the housing to the working surface to provide access to a plurality of electrical receptacles, each of which is electrically connected to line power. The unit includes a surge suppressor within the housing and disposed between the line power entering the housing and the electrical receptacles provided within the housing. The unit may also include an isolated compartment for accommodating lines connected to sensitive equipment, such as computers, for isolating these lines from electrical interference generated in other portions of the housing.

16 Claims, 3 Drawing Sheets

REMOVABLE DESKTOP ELECTRICAL RECEPTACLE UNIT

BACKGROUND OF THE INVENTION

The present invention is directed to electrical receptacle units, and in particular electrical receptacle units adapted to be mounted proximate to a work area.

Working areas, including desktop surfaces, tables and the like, require electrical power sources to run numerous items of equipment, as for example, computers, recorders, fax equipment, telephone equipment, and lighting equipment. It is therefore important to provide a plurality of electrical receptacles into which equipment may be plugged, proximate to a work surface so as to provide immediate and ready access to electrical receptacles for plugging and unplugging electrical equipment. Moreover, it is desirable to avoid the running of multiple electric cords from a work surface to a wall outlet as a result of the inherent danger in electrical cords running along a floor surface of a work area, and for aesthetic purposes to avoid an unsightly work area cluttered by a multiplicity of electrical cords extending over the work surface.

Equipment currently used in the workplace, as for example, computer equipment, facsimile equipment, and voice mail equipment, is sensitive to surges in line current and to electrical interferences. It is therefore desirable to provide a surge suppressor filter disposed between line current and electrical receptacles coupled to line current contained within a desktop receptacle unit. It is further desirable to provide an isolated compartment within the desktop unit for accommodating wires or other connectors coupled to sensitive electrical equipment, as for example, computer equipment, to provide shielding for these wires or other electrical connectors.

In today's workplace, it is common to rearrange the workspace and work areas of employees on a reasonably regular basis. It is therefore desirable to provide an electrical receptacle unit which is removably mounted to a work surface so as to facilitate any desired rearrangement or repositioning of the work area.

It is the primary object of the present invention to provide an electrical receptacle unit mounted to a work area, as for example, a desktop or a table top, which has a cord coupled to line power, and which provides a plurality of electrical receptacles for plugging and unplugging electrical equipment used in the work area. The unit includes a housing which is removably mounted to the work surface so as to facilitate any desired rearrangement or repositioning of the work area. In further aspects of the invention, the desktop mounted unit includes a housing having a surge suppressor filter therein disposed between the source of line power delivered to the housing and the plurality of electrical receptacles provided in the housing. In a further aspect of the invention, the housing defines an isolated compartment which is shielded from the remaining portions of the housing so as to prevent electrical interference generated in the other portions of the housing from interfering with electrical wires or other connectors accommodated within the isolated compartment which are provided to couple line power to sensitive electrical equipment, such as computer equipment.

Other features and advantages of the present invention will become apparent to those skilled in the art from the further discussion of the invention herein.

SUMMARY OF THE INVENTION

The present invention provides an electrical receptacle unit having a plurality of electrical receptacles and being mountable proximate to a work surface, as for example, a desktop or a table top. The unit in accordance with the present invention includes a housing having an inlet and which receives an electrical power cord which can be connected to an external source of line power for delivering line power into the housing. A plurality of electrical receptacles are defined within the housing and coupled to the source of line power for providing access to line power through the housing such that electrical equipment to be used in the work area may be plugged into and out of the individual receptacles of the housing, as desired by the user. The unit further includes means for removably mounting the housing to the work surface. In a first preferred embodiment of the invention, a mounting element extends directly from the housing and adjustable clamp means are operatively associated with the mounting element for removably and selectively securing the housing to a predetermined work surface. In a second preferred embodiment of the invention, a mounting element defines a free end folded below the work surface, and tension adjustment means operatively associated with the free end are provided to releasably secure the housing to the work surface.

In a further aspect of the invention, the unit includes therein a surge suppressor filter disposed between the power cord delivering line power to the housing and the plurality of receptacles provided in the housing. In this manner, surges in line current or voltage, which may damage equipment electrically connected to the receptacles of the housing, are controlled.

In a still further aspect of the present invention, the housing defines an isolated compartment shielded from the remaining portions of the housing. The isolated compartment is provided for accommodating electrical wires or other connectors which couple line power delivered to the housing to sensitive electrical equipment, as for example, computer equipment. In this manner, the wires or other electrical connectors extending through the isolated compartment defined in the housing are shielded from electrical interference generated in portions of the housing outside the isolated compartment.

Further features and advantages of the removably mounted electrical receptacle unit in accordance with the present invention will become apparent to those skilled in the relevant art from the following discussion.

DESCRIPTION OF THE BEST MODES FOR CARRYING OUT THE INVENTION

Figure 1:
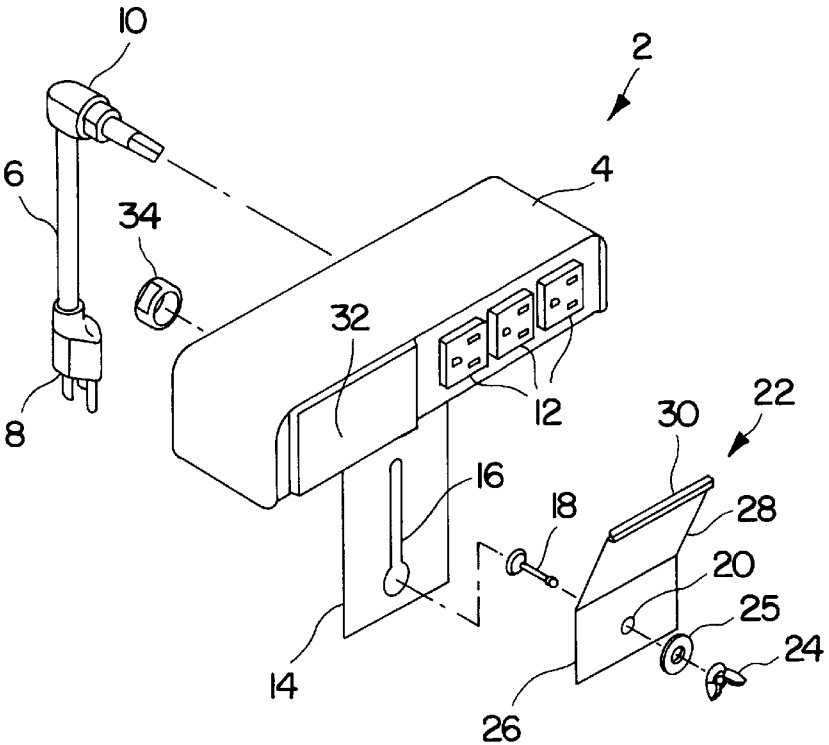
FIG. 1 illustrates, in perspective, an exploded view of a first embodiment of an electrical receptacle unit in accordance with the present invention.

FIG. 1 of the drawing illustrates a first embodiment of an electrical receptacle unit, removably mounted to a work surface, in accordance with a first aspect of the present invention. The electrical receptacle unit, which is generally designated by reference numeral 2, includes a housing designated by reference numeral 4. An electrical power cord 6 defines a plug 8 at the free end thereof, and the opposed end of the power cord includes a coupling element 10 for electrically coupling the power cord to the housing 4 through a suitable opening therein. Accordingly, electrical line power is delivered to the housing 4 by plugging the plug 8 into a source of electrical line current, as for example an electrical wall outlet. Three electrical receptacles designated by reference numeral 12 are provided in the housing 4, and line current is delivered to each of the receptacles 12 through the electrical power cord 6 received within the housing 4. The number of individual receptacles 12 provided by the unit 2 can vary, and three receptacles are shown only for illustrative purposes.

A plate-like mounting element 14 extends downwardly from the bottom surface of the housing 4 in a substantially perpendicular orientation relative to the bottom surface. Preferably, the top portion of the mounting element 14 is proximate to the rear surface of the housing 4, as more clearly illustrated by FIG. 2. The mounting element 14 c an be integrally formed with the housing 4. Element 14 defines a key-hole shaped slot 16 for receiving therein a screw 18. The head of the screw 18 is removably retained within the narrow portion o f the slot 16 because the diameter of the head is greater than the width of the narrower portion of the slot. The free end of the screw passes through an opening 20 defined in a segment of a clamp element 22, and a wing nut 24 is removably mounted to the forward portion of the screw 18 ex t ending forwardly from the opening 20. As illustrated in greater detail in FIG. 2, the clamp element 22 is formed from a substantially vertical component 26 in which the opening 20 is defined, and an integral component 28 extending from component 26 and bent at an angle in a direction oriented forwardly relative to component 26 and the mounting element 14. The clamp element 22 further includes a substantially horizontal lip portion 30 defined at the top of the forwardly angled portion 28.

The mounting element 14 is operatively associated with the clamp element 22 such that the clamp element is vertically movable up and down relative to the mounting element 14 through the keyhole slot 16 defined therein. The clamp element 22 may be releasably locked in a selected position on the mounting element 14 by tightening the wing nut 24. A washer 25 is disposed between the wing nut 24 and the front surface of the component 26 of the clamp element 22. The range of movement of the clamp element 22 relative to t he mounting element 14 (and thus the housing 4) is defined by the vertical length of the keyhole slot 16 defined in the mounting element 14. As will be discussed herein, the operative relationship between the mounting element 14 and the clamp element 22 provides means for removably mounting the housing 14 to a work surface, in accordance with one aspect of the present invention.

Still referring to FIG. 1, the housing 4 defines therein a compartment 32, which is isolated from the remaining portions of the housing by an internal barrier. As will be discussed herein, the isolated compartment 32 accommodates electrical wires or other electrical connectors coupled to sensitive equipment, as for example, computer equipment. The wires accommodated within the isolated compartment 32 are coupled to the source of line current delivered to the housing 4 at an inlet end thereof, and are coupled at their other ends to the desired electrical equipment through a suitable opening in the rear surface of the housing 4. A plug 34 can be provided to seal the opening in the housing 4 at the rear end of the compartment 32 when the compartment 32 is not in use. The isolated compartment 32 shields the connectors extending therethrough from electrical interference generated in other portions of the housing 4. Preferably, the barrier provided to isolate the compartment 32 from the remaining portions of the housing 4 is formed from a steel plate.

Figure 2:
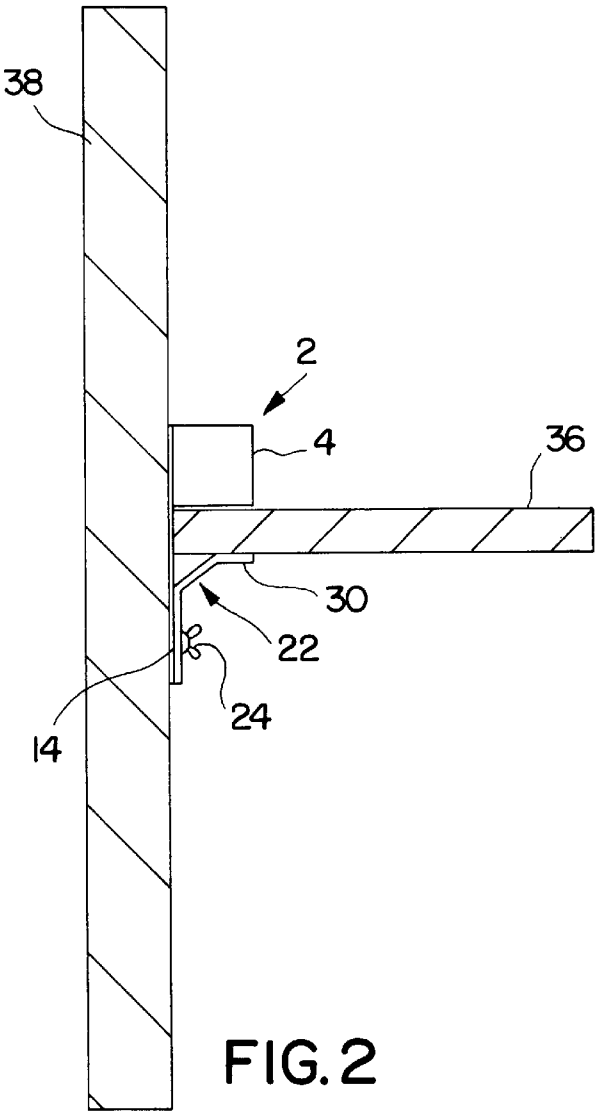
FIG. 2 is a schematic view, in section, showing one manner of removably mounting an electrical receptacle unit to a work surface.

FIG. 2 is a schematic representation, in section, illustrating one manner in which the electrical receptacle unit shown in FIG. 1 is removably mounted to a work surface. The work surface is designated by reference numeral 36 and extends in a substantially perpendicular direction from a vertical panel (e.g., a wall panel) designated by reference numeral 38. The downwardly extending mounting element 14 is disposed between the rear end of the work surface 36 and the forward end of the panel 38. If the work surface is permanently mounted to the panel, a suitable opening is provided therebetween to receive the mounting element 14. If the work surface 36 is not permanently affixed to the panel 38, then the mounting element 14 will be affixed to the front surface of the panel 38 (as for example, by conventional mounting means such as screws) and the work surface 36 will be mounted to the mounting element 14 by moving the clamp element 22 relative to the mounting element 14 such that the upper lip 30 of the clamp supports the lower surface of the work surface 36. As previously noted herein, the clamp element 22 is selectively movable relative to the mounting element 14 by loosening the wing nut 24, and thereafter the wing nut is tightened when the clamp element 22 is in the desired supporting position relative to the mounting element 14 and the work surface 36 to releasably secure the housing 4 to the work surface 36.

Figure 4:
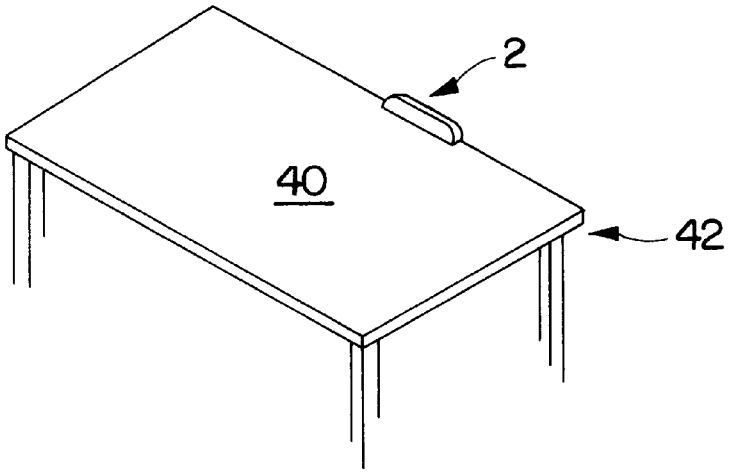
FIG. 4 illustrates a perspective view of a different manner of mounting an electrical receptacle unit in accordance with the present invention to the top surface of a table.

Therefore, in accordance with one aspect of the present invention, the electrical receptacle unit 2 is removably mounted to a work surface by positioning the unit atop the work surface such that the mounting element 24 extends down and below one end of the work surface, and the clamp element 22 is selectively moved relative to the mounting element until it tightly abuts against the lower surface of the work surface, and thereafter the clamp element is releasably locked in position (by tensioning adjustment means) relative to the mounting element 14 a nd the work surface 36 so as to removably secure the housing 4 at a predetermined position on the top surface of the work surface 36. Although FIG. 2 illustrates the electrical receptacle unit 2 releasably locked to a work surface 36 extending from a vertical panel 38, FIG. 4 illustrates the electrical receptacle unit 2 mounted to the top surface 40 of a work table 42. The unit 2 is removably mountable to the table 42 in the same manner as described with respect to FIG. 2, except that the mounting element 14 does not abut against or is not affixed to a vertical panel 38, but the mounting element 14 merely extends downwardly from one edge of the top surface 40 of the table 42. The electrical receptacle unit 2 is releasably secured to the edge of the table top 40 by movement of the clamping element 22 relative to the mounting element 14 extending downwardly from the top surface 40 of the table 42, and by releasably locking the clamp element by the tensioning means (the wing nut) in a predetermined position on the mounting element to securely clamp the electrical receptacle unit 2 to the top of the table surface 40 in a manner similar to that previously described with reference to FIG. 2.

Figure 3:
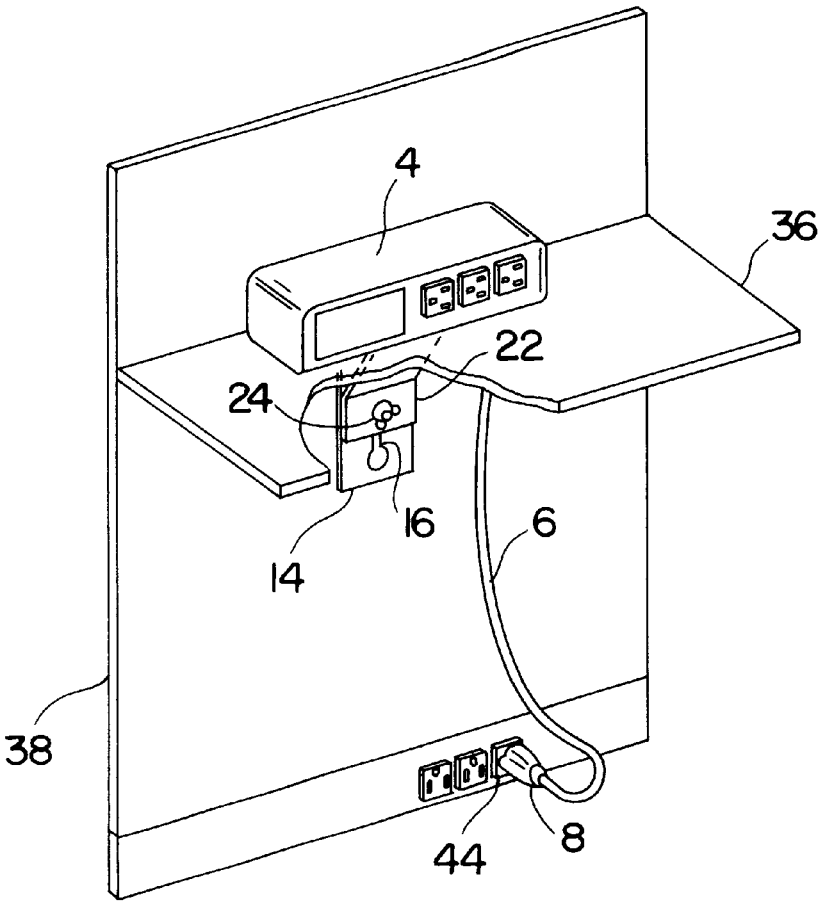
FIG. 3 illustrates a perspective view of an electrical receptacle unit mounted to a work surface in the manner illustrated by FIG. 2.

FIG. 3 illustrates a perspective view of FIG. 2 showing the electrical receptacle unit 2 releasably secured to the work surface 36 as a result of the operative interrelationship between the mounting element 14 and the clamp element 22. The same reference numerals are used in FIG. 3 to designate corresponding elements in FIGS. 1 and 2. When the electrical receptacle unit 2 is releasably locked into its operating position on the top of the work surface 36, the plug 8 of the electrical cord 6 is plugged into a wall outlet 44 to deliver electrical line power to the unit 2.

Figure 6:
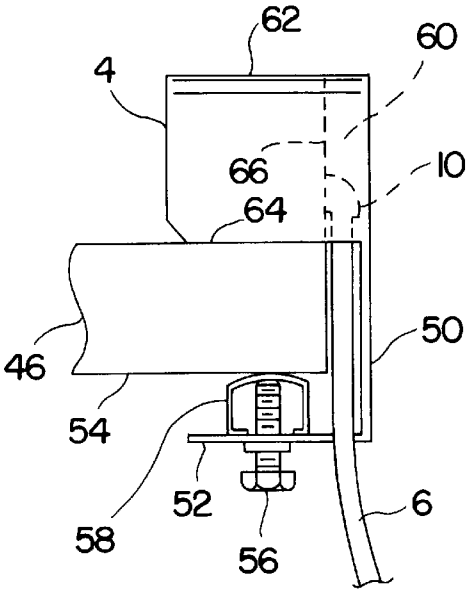
FIG. 6 illustrates a side elevational view, partially in section, of the electrical receptacle unit mounted to the work surface as illustrated by FIG. 5.
Figure 5:
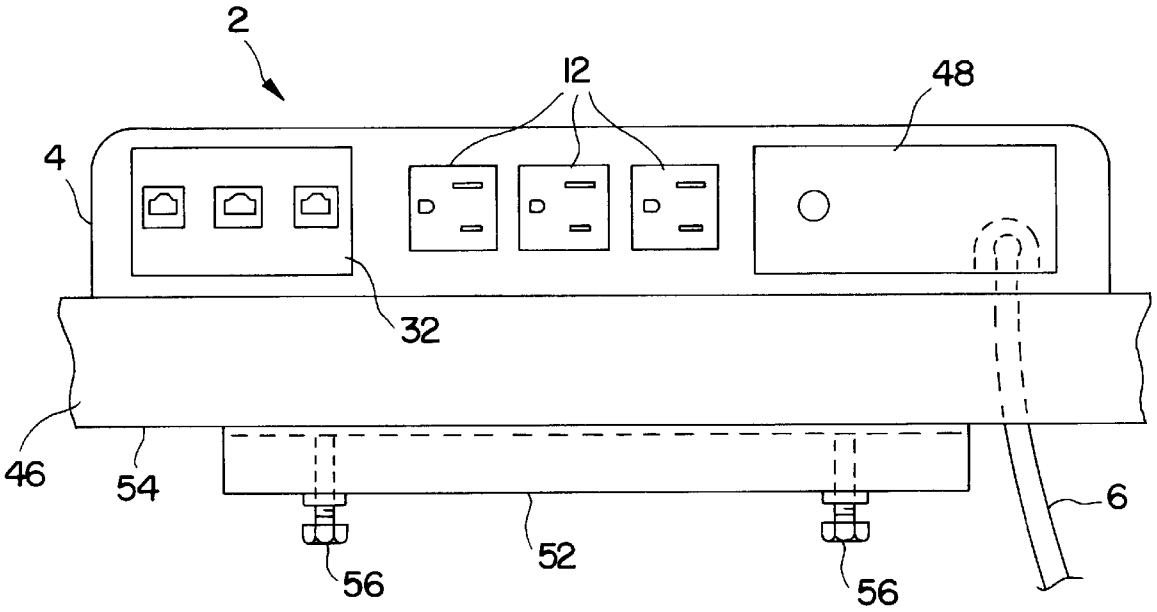
FIG. 5 illustrates a front elevational view, partially in section, of another embodiment of an electrical receptacle unit in accordance with the present invention, mounted in a different manner to a work surface.

FIGS. 5 and 6 illustrate modifications to the electrical receptacle unit and means for mounting the same to a work surface, as disclosed in FIGS. 1–4. The same reference numerals are used in FIGS. 5–6 to designate corresponding elements of FIGS. 1–4. Referring to FIGS. 5–6, the electrical receptacle unit 2 includes the housing 4 which contains therein three electrical receptacles 12 and the isolated compartment 32, each of which has been previously illustrated by FIG. 1. The unit 2 is shown as mounted to the top surface of a work surface, (as for example, work surface 36 shown in FIG. 2 or work surface 40 shown in FIG. 4). The work surface is designated by reference numeral 46 in FIGS. 5 and 6. The housing 4 illustrated by FIG. 5 further includes therein a surge suppressor filter designated by reference numeral 48. The surge suppressor 48 is disposed between the electrical power cord 6 (coupled to line power—See FIG. 3) so that the electrical line power delivered to the housing 4 flows through the surge suppressor filter 48 before it is delivered to the electrical receptacles 12 or the wires accommodated in the isolated compartment 32.

A mounting element 50 extends downwardly from the rear of the housing 4 substantially parallel to an end of the supporting surface 46 proximate to the position at which the housing 4 is mounted thereon. The mounting element can be integrally formed with the housing. A free end 52 of the downwardly extending mounting element 50 is bent in a substantially perpendicular orientation and extends inwardly in a direction which is substantially parallel to and below the lower surface 54 of the supporting surface 46. Accordingly, the configuration of the mounting element 50 and the bent free end 52 generally complements the configuration of an end of the supporting surface 46 to which the housing 4 is mounted. The mounting element 50 is releasably secured to the edge of the supporting surface 46 by conventional mounting means, as for example tension adjustment means including a threaded element 56 received through a suitable opening in the free bent end 52 of the mounting element so as to adjustably and selectively securely engage the lower surface 54 of the supporting surface 46 to releasably and removably lock the housing 4 atop the supporting surface 46, as illustrated by FIG. 6. FIG. 5 illustrates that a plurality of elements 56, which may be bolts or screws, can be received through a plurality of corresponding openings in the bent end 52 of the mounting element 50 so as to releasably secure the housing 4 to the work surface 46 at more than a single position along the work surface. As illustrated by FIG. 6, a dome element 58 may be disposed over the free end of the threaded element so that the threaded element does not directly engage the lower surface 54 of the supporting surface 46 when the housing 4 is in a position in which it is securely mounted to the top of the working surface 46.

FIG. 6 further illustrates a recessed compartment, designated by reference numeral 60, defined at the rear end of the housing 4. The compartment 60 is defined between upper and lower walls 62 and 64 of the housing 4, and a recessed rear wall of the housing designated by reference numeral 66. The compartment 60 provides a space in which the coupling element 10 of the electrical cord 6 can be connected to the housing 4 without physically interfering with other nearby structure. The compartment 60, as illustrated by FIG. 6, is opened at the rear, but can be sealed as, for example, when the unit 2 is mounted to a wall or panel, as illustrated by FIG. 2.

In each of the embodiments of the invention discussed herein, preferably the housing 4 and the downwardly extending mounting element 14 are formed from heavy gauge galvanized steel. In the embodiments of the invention employing a separate movable clamp element 22, preferably the clamp element is also formed from heavy gauge galvanized steel.

Other modifications of the electrical receptacle unit described herein within the scope of the present invention will be apparent to those skilled in the art. For example, the number of receptacles provided in the housing can vary from that shown in the drawing. Accordingly, the discussion of the preferred embodiments of the invention herein are intended to be illustrative only, and not restrictive of the scope of the invention, that scope defined by the following claims and all equivalents thereto.

I claim:

1. An electrical receptacle device comprising:

a housing, a plurality of electrical receptacles in said housing, means for delivering electrical power to said housing, and means for removably mounting said housing to a work surface, said means for removably mounting said housing to said work surface including a mounting element extending from said housing and a clamp element slidably movably mounted to said mounting element for selectively releasably locking said housing to said work surface, said clamp element being separable from said mounting element extending from said housing.

2. The device as claimed in claim 1 further comprising:

at least one compartment defined in said housing, said compartment being shielded to prevent penetration of electrical interferences therein.

3. The device as claimed in claim 1 further comprising:

electrical surge suppression means within said housing, said electrical surge suppression means being disposed between said means for delivering electrical power to said housing and said plurality of electrical receptacles in said housing.

4. The device as claimed in claim 1, wherein said mounting element extends integrally from said housing.

5. The device as claimed in claim 1, wherein said mounting element defines a slot therein, and said clamp element is movably relative to said mounting element along said slot.

6. The device as claimed in claim 1, wherein said housing defines a recessed compartment at a rear end thereof.

7. The device as claimed in claim 1, wherein said mounting element extends from said housing at a position substantially proximate to a rear end of said housing.

8. The device as claimed in claim 1, wherein said mounting element extends from said housing along a plane which is oriented substantially perpendicular to a lower surface of said housing.

9. The device as claimed in claim 1, wherein said clamp element includes a surface thereon which is oriented in a direction substantially parallel to the work surface to which said housing is removably mounted such that said surface of said clamp element is engageable with said work surface for releasably locking said housing to said work surface.

10. The device as claimed in claim 1 further including means for releasably locking said clamp element at selected positions on said mounting element.

11. The device as claimed in claim 10, wherein said mounting element defines a slot therein, and said clamp element is movable relative to said mounting element along said slot; said means for releasably locking said clamp element relative to said mounting element including adjustable tensioning means operatively associated with said clamp element and said mounting element.

12. The device as claimed in 11, wherein said adjustable tensioning means includes a threaded element having a head received within said slot in said mounting element, a free end of said threaded element passing through an opening defined in said clamp element, and a wing nut mounted to said free end of said threaded element passing through said opening in said clamp element.

13. The device as claimed in claim 1, wherein said mounting element extending from said housing includes a free end thereof which is oriented to extend in a direction below said work surface to which said housing is removably mounted.

14. The device as claimed in claim 13, further including means operatively associated with said mounting element for adjusting tension between said mounting element and said work surface for removably locking said housing to said work surface.

15. An electrical receptacle device comprising:

a housing including at least one electrical receptacle provided therein, and means for removably mounting said housing to a work surface, said means for removably mounting comprising: a mounting element extending from said housing along a plane which is oriented substantially perpendicular to a longitudinal axis of said housing, a clamp element movably mounted to said mounting element for relative movement thereto, and means for removably locking said clamp element at selected positions relative to said mounting element, said clamp element comprising means for engaging said work surface when said housing is removably mounted to said work surface; said clamp element being separable from mounting element.

16. The device as claimed in claim 15, wherein said mounting element defines a slot, said clamp element is slideably movable relative to said mounting element along said slot, and means are provided for adjusting tension between said clamp element and said mounting element for removably locking said clamp element at selected positions relative to said mounting element.

* * * * *